US005356030A

United States Patent [19]

Büdenbender

[11] Patent Number: 5,356,030

[45] Date of Patent: Oct. 18, 1994

[54] CONTAINER HAVING AT LEAST ONE FILLING OPENING WITH A THREADED CLOSURE

[76] Inventor: Bernd Büdenbender, Schubertweg 5, 2160 Stader, Fed. Rep. of Germany

[21] Appl. No.: 672,662

[22] Filed: Mar. 20, 1991

[30] Foreign Application Priority Data

Mar. 20, 1990 [DE] Fed. Rep. of Germany ..... 4008964

[51] Int. Cl.[5] ..... B65D 6/40; B65D 41/04

[52] U.S. Cl. ..... 220/601; 220/288; 220/661; 220/DIG. 4; 285/392; 285/901

[58] Field of Search ..... 220/288, 601, 661, 582, 220/DIG. 4; 285/392, 901

[56] References Cited

U.S. PATENT DOCUMENTS

| | | | |
|---|---|---|---|
| 698,217 | 4/1902 | Newton | 220/288 X |
| 1,822,114 | 9/1931 | Schwartz | 220/288 |
| 1,952,036 | 3/1934 | Dillhoefer, Jr. | 220/288 X |
| 2,160,598 | 5/1939 | Melrath | 220/288 X |
| 2,165,622 | 7/1939 | Donahue | 285/392 |
| 2,192,498 | 3/1940 | Hyman | 285/392 X |
| 2,447,536 | 8/1948 | Robinson | 220/288 X |
| 2,819,001 | 1/1958 | Pottle | 220/601 X |
| 3,264,850 | 8/1966 | Bower | 220/288 X |
| 4,588,103 | 5/1986 | Baughman | 220/288 |

FOREIGN PATENT DOCUMENTS

| | | | |
|---|---|---|---|
| 3926821 | 2/1990 | Fed. Rep. of Germany . | |
| 3934210 | 4/1991 | Fed. Rep. of Germany . | |
| 741559 | 12/1955 | United Kingdom . | |
| 2033567 | 5/1980 | United Kingdom | 220/601 |

*Primary Examiner*—Allan N. Shoap
*Assistant Examiner*—Vanessa Caretto
*Attorney, Agent, or Firm*—Herbert Dubno; Yuri Kateshou

[57] ABSTRACT

A tubular fitting of sheet metal is formed in one piece of a container, for example, a bung container and an internally threaded bushing is press fitted into tubular fitting or is held therein by formations, texturing and/or adhesive and is braced axially against a bead formed on the free end of the tubular fitting.

6 Claims, 5 Drawing Sheets

CONTAINER HAVING AT LEAST ONE FILLING OPENING WITH A THREADED CLOSURE

FIELD OF THE INVENTION

My present invention relates to a container having at least one filling opening in the form of a thin wall tubular fitting and provided with an internal thread for threaded engaged with an external thread on a closure plug or stopper.

BACKGROUND OF THE INVENTION

German Patent Document DE-OS 39 26 821 describes a container in which the upper wall or cover of the container body is provided with filling openings at least in part by pressing, drawing or otherwise deforming sheet metal of the cover to form a tubular fitting surrounding the filling opening so that the tubular fitting is composed of thin wall sheet metal and is provided in one piece with the cover.

In this system, an internal screw thread can be pressed into the tubular setting or machined therein, The screw thread is adapted to engage in an externally threaded stopper or plug which is screwed into the tubular fitting.

A seal is formed by the plug or stopper against the cover of the container or against a shoulder formed by the tubular fitting itself and, for this sealing action the plug can thereby be seated against the cover or the tubular fitting and sealing between the tubular fitting and the cover does not pose a problem since the fitting is formed in one piece with the cover portion of the container.

This type of system, however, presents a significant problem when the material from which the tubular fitting is formed and is thus drawn from the cover, is relatively thin. The formation of screw threads therein becomes difficult and the contours of the internal screw thread may be lost. The problem can be only partially solved by coining the material of the tubular fitting to make it thicker.

By and large, therefore, it is difficult to provide sufficiently deep screw threads as usually are necessary for effective retention of the plug or stopper in such thin materials. Indeed, it has been proposed to form the tubular fittings from relatively thick materials and to weld them to the top wall or cover of the container. The threaded bushings used for this purpose require an additional and expensive welding operation and frequently present a problem with respect to effectiveness of the weld and thus the seal between the threaded bushing and the cover.

In German Patent Document 3,934,210, an internal screw thread for a tubular fitting is formed by a helical spring composed of steel wire and received in the tubular fitting and welded thereto. This system requires expensive welding operations or deformation steps to anchor the helical spring with its turns in the proper spacing or against the axial stresses which are applied thereto when the threaded stopper or plug is tightened in the tubular fitting.

The U.K. Patent Document GB 741,559 describes a beer barrel fabricated from aluminum and having filling openings in which bungs are welded. To enable problem-free welding, the bung is also composed of a light metal such as aluminum. However, it has been found that a bung of this type is excessively soft so that repeated closure by plugs or stoppers or the like or the connection of pipes to the bung will give rise to substantial wear. This is a significant drawback with respect to the reuse of the barrel.

In the relatively thick-wall bung, a screw thread can be formed in which a threaded bushing of harder material, preferably steel, can be screwed. This bushing is formed with a second screw thread, for example, a trapezoidal-profile internal thread, for engagement with the stopper or the like. This, of course, allows the internal screw thread of the bushing to be relatively shallow, but it does require a thick wall construction with a high consumption of relatively expensive material and frequently also requires an expensive welding process if an absolute seal is to be provided between the bushing and the bung.

OBJECTS OF THE INVENTION

It is, therefore, the principal object of the present invention to provide an improved container whose securing opening is defined by a tubular fitting formed unitarily (i.e. in one piece) with the container whereby the aforementioned drawbacks are avoided.

Another object of this invention is to provide a tubular fitting which can be of thin wall construction and formed unitarily with a cover or upper wall of a container and which is provided with a screw thread affording a firm, highly stressable retention of the stopper and hence good sealing effectiveness, without requiring expensive welding operations.

Still another object of the invention is to provide a container or filling opening assembly for a container which enables maintenance and replacement, for example, of a threaded bushing in a simple and economical manner.

SUMMARY OF THE INVENTION

These objects and others which will become apparent hereinafter are attained, in accordance with the invention in a sheet metal container of thin wall construction, especially a barrel or drum, which comprises:

- a container body composed of sheet metal and having top and bottom walls;
- a tubular fitting projecting outwardly from the container body formed from the sheet metal of one of the walls and unitary therewith;
- a threaded bushing received in the tubular fitting and formfittingly engaged therein, the bushing being provided with an internal screwthread;
- means forming an annular enlargement on a free end of the tubular fitting; and
- a closure stopper threadedly received in the tubular fitting an having an external screwthread threaded into the internal screwthread, an annular shoulder Juxtaposed with the annular enlargement, and an annular seal clamped between the shoulder and the enlargement.

According to the invention, therefore, the internally threaded bushing is received in the tubular fitting formed in one piece with the upper wall of the container while the free end of the tubular fitting is formed with a flange, bead, shoulder or rib engaging an annular seal of the externally threaded stopper or plug which is screwed into that bushing.

The threaded bushing can thus be accommodated in a press seat formed in the tubular fitting or otherwise engaged by some locking elements thereof so that the form fitting connection of the bushing with the fitting can take up any torque applied on the bushing by the closure operation. Such torques, arise if the stopper or plug is tightened in the bushing.

The tightening action can, if desired, brace the bushing more firmly against the annular enlargement at the free end of the tubular fitting. The threaded bushing can be held in the tubular fitting by a press fit, by engaging the threaded bushing by a hook action, by screwing the threaded bushing into the tubular fitting or a combination thereof to achieve a reliable retention without any difficulty with respect to removal of the threaded bushing and its replacement by another.

According to a feature of the invention, the threaded bushing is held in a press fit in a seat formed in the tubular fitting and is axially engaged by and held in the seat by the enlargement. The threaded bushing can, advantageously, be provided with a flange or edge zone which engages beneath a zone of the cover bonding the filling opening, i.e. a zone of one of the walls at which the tubular fitting is connected to the body of the container.

An outer surface of the threaded bushing can be frustoconically tapered and can be seated against a frustoconically tapered region of the tubular fitting.

To ensure an effective seal between the bushing and the tubular fitting, an outer surface of the threaded bushing can be formed with an annular groove receiving an O-ring sealing between the bushing and the fitting.

According to another feature of the invention, at least outer peripheral zones of the bushing and/or inner peripheral zones of the tubular fitting are textured, e.g. by kurling, shot peening, sand blasting or the like to secure the threaded bushing in its seat within the tubular fitting. In addition, or alternatively, the inner periphery of the tubular fitting and the outer periphery of the bushing can be bonded together by an adhesive interposed between them.

At least zones of the fitting and the bushing can be formed with mutually engaging elements or formations reliably seating the bushing in the fitting.

According to another feature of the invention, the enlargement forms an annular element extending inwardly of a passage through the fitting and axially supporting the bushing against axial stress applied thereto by the stopper. As noted, the threaded bushing can be held in the tubular fitting by a thread, especially a screw thread or a bayonet type of thread, the formations thereby providing a bayonet connection between the bushing and the fitting.

According to another feature of the invention, the bushing is clamped in the tubular fitting against a constriction or abutment of the tubular fitting.

In still another object of the invention, the enlargement is a Junction between a portion of the tubular fitting extending away from the top wall and an inner wall of the container toward the interior of the container from the junction, the inner wall lining the outer wall of the tubular fitting and being formed with the means for retaining the bushing in the tubular fitting.

Where the bushing has an annular shoulder, the wall from which the tubular fitting extends can be shaped complimentarily to the shoulder to receive the latter.

The bushing can be formed with a noncylindrical contour over at least a portion of its height and a tubular formation can be correspondingly shaped to conform to the noncylindrical contour. The engaging elements can be pressed from at least one of the bushing and the tubular fitting or can include elements stamped from or cut into the bushing.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
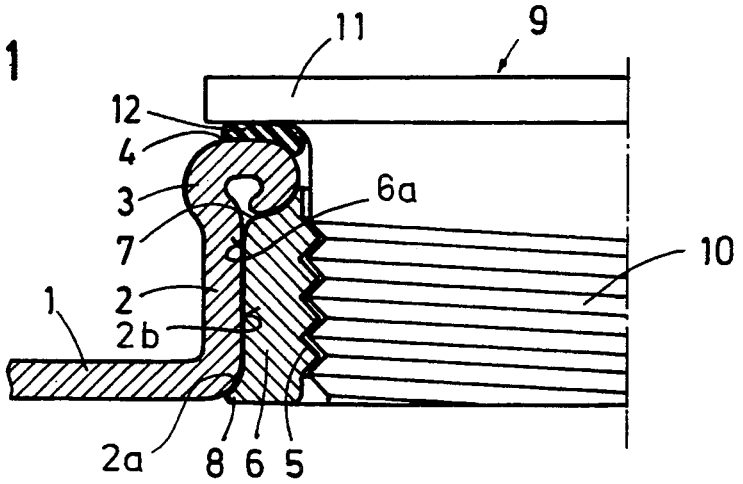
FIG. 1 is a half cross section of a closure of a container having a tubular fitting formed in one piece and in which a threaded plug is engaged according to the invention.

The upper wall 1 of a container, such as a drum or barrel, preferably composed of sheet metal, for example, steel sheet, or composed of a light metal such as aluminum, is formed with a filling opening defined within a tubular fitting two deformed from the material of the upper wall 1 and in one piece therewith. At its free end, the tubular fitting 2 is formed with a practically closed bead or bulge 3 rolled over inwardly, the upper surface 4 of which is an annular, practically planar sealing surface.

The threaded bushing 6 is press fitted into the tubular fitting 2 and has an internal screw thread 5 threadedly engaged by an external screw thread 10 of a stopper or plug which is screwed into the opening.

The upper end face of the threaded bushing 6 abuts directly against the bead 3 and the lower end of the threaded bushing 6 is formed with a flange 8 engaging below the bend 2*a* at which the fitting 2 rises from the upper wall 1.

The stopper 9 is also formed with a head plate 11, e.g. of polygonal shape, for example, a hexagonal shape, enabling the engagement of the stopper by an appropriate wrench or spanner. The plate 11 forms a shoulder of the stopper 9 each pressing a compressible sealing ring 12, e.g. of rubber of an elastomeric synthetic resin, against the surface 4 to seal the stopper against the tubular fitting 2.

This construction provides an inexpensive and easily assembled bung for a drum whose seal can be effected in a problem-free manner since the seal 12 is pressed directly by the plate or shoulder 11 of the stopper 9 against the sealing surface 4 of the bead 3. The bead 3 and the sealing surface 4, of course, together with the tubular fitting 2, are formed in one piece with the upper wall 1. The torque generated in the threaded bushing 6 as the plug 9 is tightened in the internal screw thread 5, is taken up without difficulty by the press fit and the axial force generated upon tightening of the stopper is applied directly by the surface 7 and the flange 8 to the top wall of the drum and the bead 3 which is braced or supported by the plate 11 of the plug. The Juxtaposed surfaces 2*b* of the tubular fitting and 6*a* of the threaded bushing are roughened, milled, knurled or otherwise textured to reliably retain the sleeve 6 against rotation within the tubular fitting and an adhesive, especially a high strength industrial adhesive, is applied between them to form an additional bond.

Similar texturing and adhesive application can be used in all of the embodiments described below.

As can be seen in FIG, 1, the bead 3 is an enlargement at the other end of the tubular fitting 2 opposite the bend 2*a* in the form of a bead while the other end of the threaded fitting 6 opposite that formed with the flange 8 is formed with a concave surface engaging the bulge.

Figure 2:
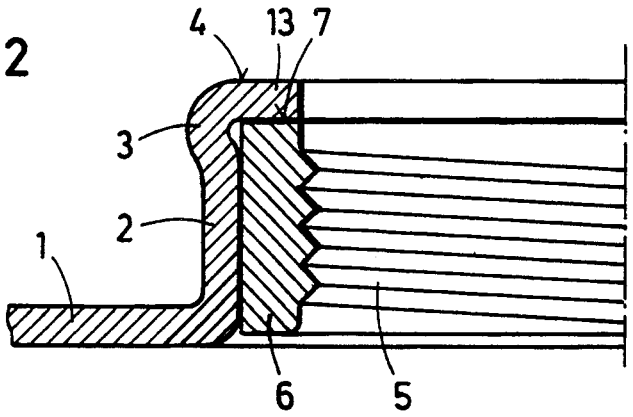
FIG. 2 is a similar cross section, without the threaded plug, of an embodiment in which an enlargement is formed by an inwardly extended flange.

A simpler variation of the invention has been illustrated in FIG. 2 wherein the reference numerals used in FIG. 1 are repeated for functionally similar elements. In this embodiment, however, instead of a fully rolled over bead 3, the enlargement 3 at the free end of the tubular fitting 2 is formed as a simple inwardly extending flange 13 forming an abutment for the inner end surface 7 of the threaded bushing 6 which is press fitted into the tubular fitting and may be held by textured surfaces and/or adhesive therein as has been described in connection with FIG. 1. In this embodiment, the flange 3 forms a wider sealing surface 4. When the stopper or plug (not shown) is tightened, the threaded bushing 6 is drawn directly against one side of the flange 13 while the head of the stopper and the seal engages the opposite side of the flange 13.

Figure 3:
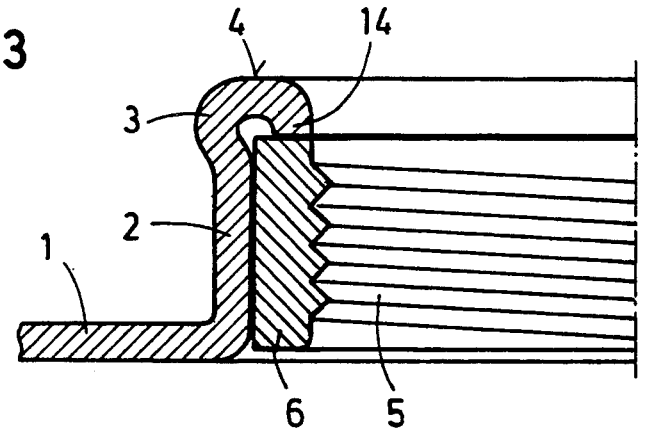
FIG. 3 is a half cross section through a tubular fitting which has an upper end turned downwardly to abut the threaded bushing.

A similar construction is provided in FIG. 3, wherein, however, the flange is downwardly turned to form a collar 14. This affords the advantages of a flat abutment against the threaded bushing 6 as well as a wide sealing surface 4.

Figure 4:
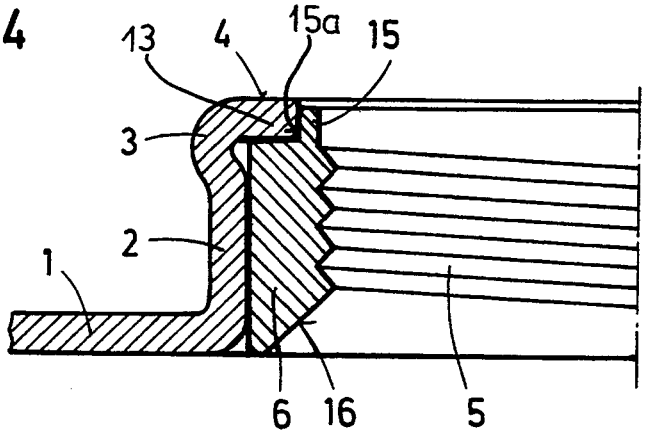
FIG. 4 is a cross sectional view similar to FIG. 2 of an embodiment which is similar thereto but wherein the flange and the bushing cooperate for centering of the bushing.

The embodiment of FIG. 4 is similar in principle to that of FIG. 2, except that in the threaded bushing 6 is formed with a tubular centering collar or boss 15 defining a step 15*a* in which the flange 13 engages. The lower end of the bushing 6 is formed with a funnel shaped or conical widening 16 facilitating the outflow of the contents of the container. A similar widening can be provided in all of the embodiments described in the present application.

Figure 5:
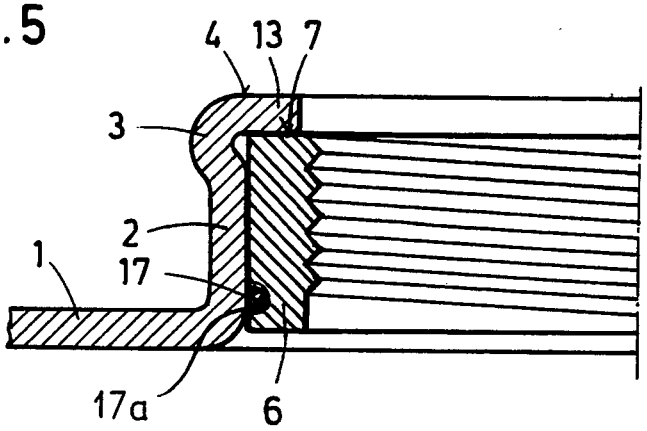
FIG. 5 is a view similar to FIG. 2 of an embodiment provided with an O-ring seal between the threaded bushing and the tubular fitting.

The embodiment of FIG. 5 is similar to that of FIG. 2 except that the bushing 6 is formed with an outwardly open circumferential groove 17*a* in which an O-ring is received, the O-ring forming a seal between the bushing 6 and the tubular fitting 2 and, when the bushing is pressed into the tubular fitting 2, provides a certain clamping effect which can assist in securing the bushing in the tubular fitting. The O-ring can bridge wide tolerances in the fabrication of the metal parts 2 and 6 which are secured together and the clamping effect can also be substantially constant for large tolerances of this type.

It is possible to provide a plurality of grooves with respective O-rings or a larger groove and a plurality of O-ring in the single groove.

When a multiplicity of O-rings are provided, a labryinth-type seal is provided and it is possible to generate sufficient adhesion force between the bushing and tubular fitting with such O-rings so that other texturing of the juxtaposed surfaces or the use of an adhesive may not be necessary. In this embodiment, as in the embodiment of FIG. 2, upon tightening of the stopper (not shown), the threaded bushing 6 has its upper surface 7 drawn against the overhanging flange 13.

Figure 6:
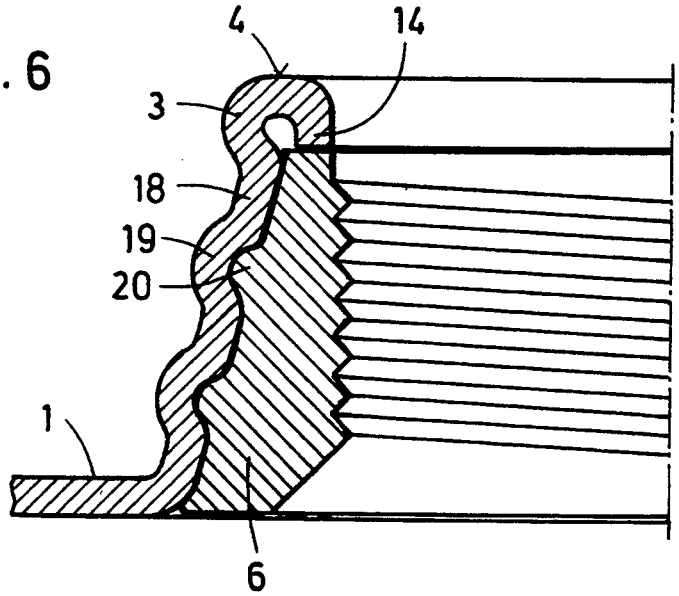
FIG. 6 is a half section of a tubular fitting and cooperating threaded bushing having a generally conical configuration and form fitting elements or formations locking the two together.

In the embodiment of FIG. 6, the tubular fitting 18 has generally a conical configuration and is formed with a bead 3 at its free end defining a collar 14 which abuts the threaded bushing 6 (see FIG. 3). The threaded bushing 6 can be externally frustoconical with a similar taper and can be formed with an external screw thread 20 of rounded profile which is of the same pitch and threadedly engages in internal screw thread 19 pressed into the tubular fitting 18. The screw threads 19 and 20 can be very course pitch screw threads and, if desired, a double or multi screw thread can be provided.

It is also possible to provide the formations 19 and 20 as respective annular recesses and bulges which can be engaged one in the other when the threaded bushing or sleeve 6 is forced into the seat formed by the tubular fitting 6.

The construction can be kinematically reversed and the bulges can be provided on the tubular fitting while the recesses or troughs are provided on the threaded bushing.

Furthermore, the threaded bushing can have projections such as studs or the like which can engage in troughs of the tubular fitting or vice versa.

In all of these cases, when the stopper is tightened, an effective anchoring is obtained because the threaded body is drawn more tightly into the tapered tubular fitting 18 and into abutting relationship with the collar 14.

Figure 7:
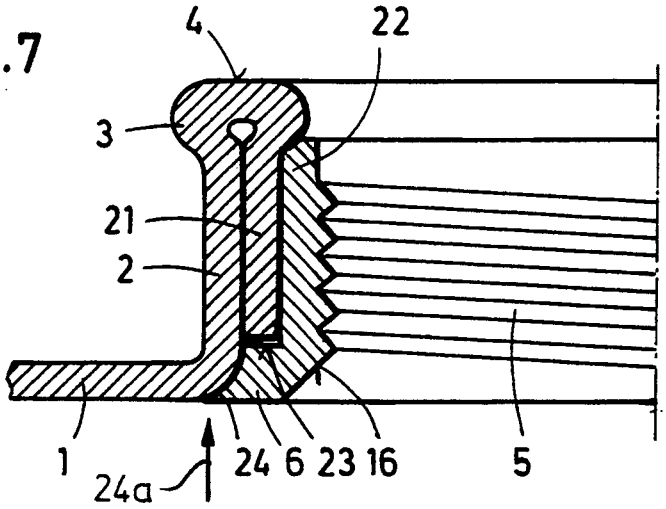
FIG. 7 is a similar cross section view in which an inner wall is provided on the tubular fitting and is engaged from below by a flange of the threaded bushing.

In the embodiment of FIG. 7, the collar is extended downwardly to form an inner wall 21 of the tubular fitting 2 which lines the outer wall thereof. The threaded bushing 6 is secured within the tubular fitting and to the inner wall by a press fitting, adhesive, texturing and/or form locking mutually engaging formations as have been described at least against rotation and against dropping out of the tubular fitting.

When the stopper, for example, the stopper 9 of FIG. 1, is tightened into the threaded bushing 6, the upper end of the bushing 6 wedges at 22 against an overhanging portion of the bead 3 while a shoulder 23 is formed by a flange 6 can abut the lower end of the inner wall 21.

The force applied to the bushing 6 is represented by the arrow 24*a* in FIG. 7 and it can be seen that the flange 24 also overhangs the region of the wall 1 at which a junction is formed with the tubular fitting 2.

Figure 8:
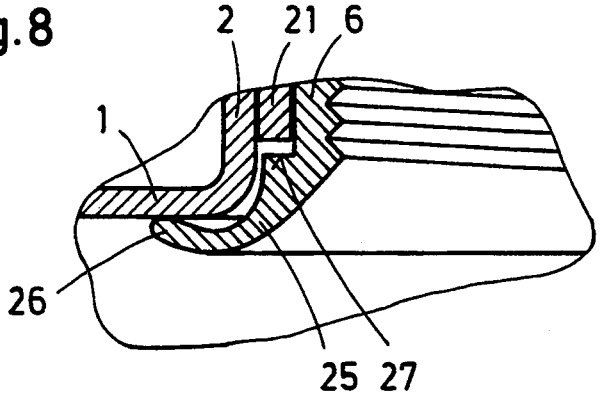
FIG. 8 is a detailed view of an embodiment in which the threaded bushing has a sealing lip engaging beneath the top wall of the container adjacent the junction of the tubular fitting therewith.

From FIG. 8, it will be apparent that the bottom of the tubular fitting 6 can be formed with a flange 25 which extends further beneath the upper wall 1 of the container and is formed at its free end with a sealing lip braced against the inner surface of the upper wall 2 when the axial force is applied to the threaded bushing 6. In this case, the shoulder 27 is set downwardly from the end of the inner wall 21 so that it will not engage the bottom of the inner wall 21 when the stopper is tightened, thereby permitting the sealing lip 26 to engage with full pressure against the wall 1.

Figure 9:
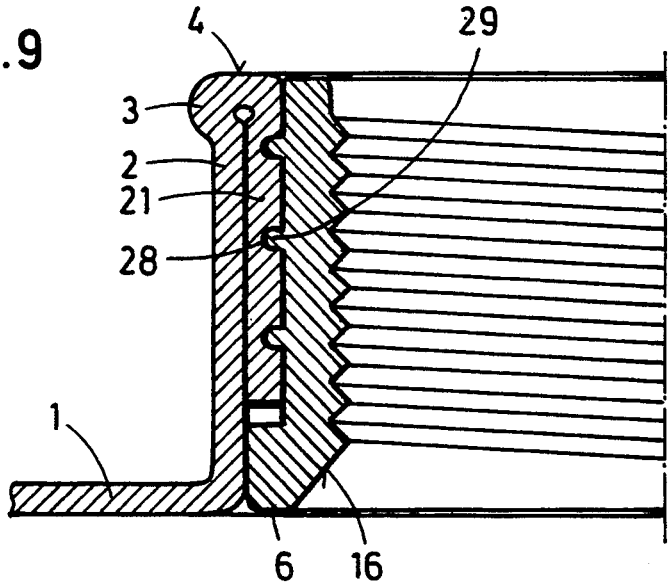
FIG. 9 is a half section through a tubular fitting and its bushing where the tubular fitting is of double wall construction and the inner wall is in form fitting engagement with the bushing.

In the embodiment of FIG. 9, an inner wall 21 is also provided for the tubular fitting 2 and the threaded bushing 6 is formed with a coarse outer thread 29 which can be received in a complementary helical groove 28 pressed into the inner wall 21. Instead of screw thread formations 28 and 29, protuberances, troughs or throughgoing grooves may be used to form the interfitting formations.

Figure 13:
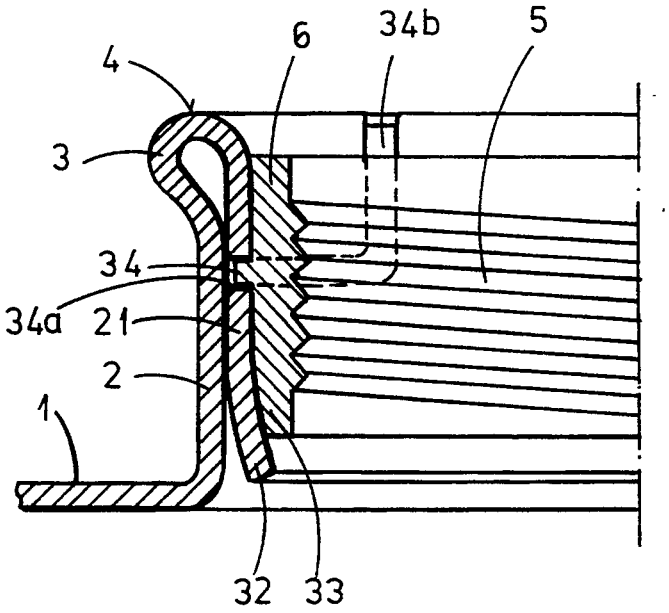
FIG. 13 is a view very similar to FIG. 12 which is further provided with a bayonet connection between the threaded bushing and the inner wall.

Alternatively, a bayonet connection can be provided as has been shown in principal in FIG. 13. The inner wall 21 need not be provided with grooves, but rather can have projections which engage in grooves formed in the threaded bushing and the projections or grooves can be provided by stamping, embossing or any other technique.

Finally, the formations in the relatively thin wall tubular fitting wall can be shaped around or into the formations on the thick wall threaded bushing if desired.

Figure 10:
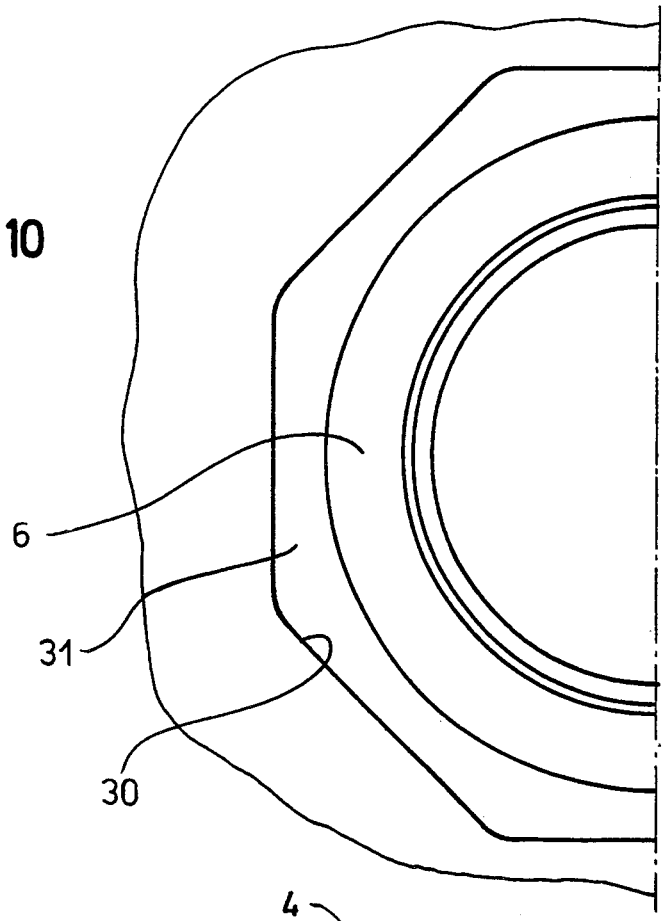
FIG. 10 is a top plan view of half of a tubular fitting having a flange on the threaded bushing which engages in a stepped portion connected to the tubular fitting and having an outline deriving from a circular configuration.
Figure 11:
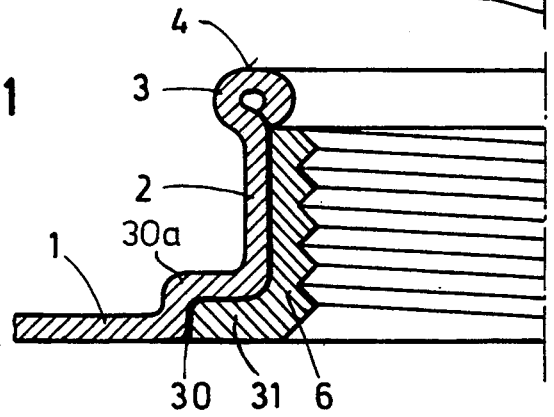
FIG. 11 is a half section through the device of FIG. 10.

The threaded bushing can be secured against rotation in the tubular fitting as is illustrated, for example, in FIGS. 10 and 11. In this embodiment, the flange 31 of the tubular fitting 6 can be polygonal, i.e. in a body of revolution, so that it can be received in a correspondingly shaped recess 30. In the embodiment shown, the flange 31 is octagonal as is the recess 60 so that the recess 30, provided as a step 30*a* in the wall 1, can brace the bushing 6 against axial force while also being able to withstand high torques which might be applied to the bushing upon tightening of the stopper.

Figure 12:
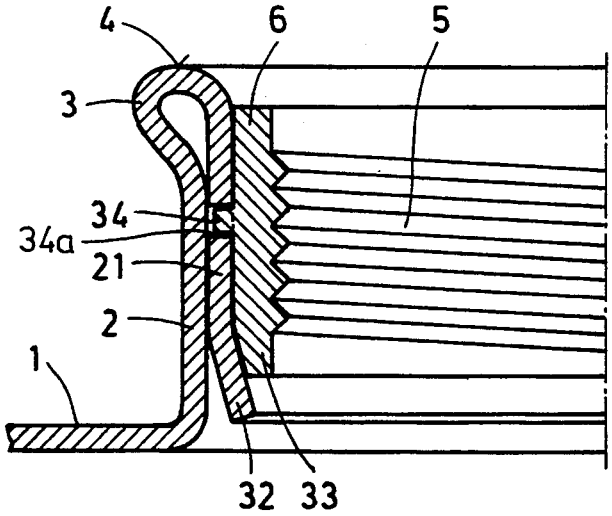
FIG. 12 is a half section of a device in which a double wall tubular fitting has a conically tapered inner wall against which the threaded bushing is braced.

The embodiment of FIG. 12 represents a system in which the threaded bushing can not only be easily introduced into the tubular fitting but can be easily removed should that be necessary. The inner wall 21 of the tubular fitting 2 terminates here in a conically constricted region 32 and the threaded bushing 6 has a correspondingly formed end 33 to engage the constriction and seat there against with a press fit.

The bushing 6 is also formed with a plurality of outwardly projecting locking elements 34 which engage in a screw thread stamped or machined in the inner wall 21. The recess is represented generally at 34*a* in FIG. 12. As can be seen from FIG. 13 a recess 34*a* can start at 34*b* in the region of the bead to form a bayonet connection with the threaded bushing 6. The horizontal portion 34*a* may have a slight inclination to ensure tightening of the threaded bushing 6 when it is rotated after bayonet engagement in the tubular fitting, thereby clamping the conical ends 32 and 33 of the tubular fitting and the bushing against one another. If desired, a slight undercut can be provided toward the end of the movement of the projection 34 in the slots 34*a*, 34*b* to further restrict release of the threaded bushing. When necessary, of course, a bushing can be pulled out, thereby breaking off the projections 23, two or more of which are provided on the bushing, and enabling replacement of that bushing.

In all of the embodiments, a sealing layer or ring is clamped against a bead 3 of a tubular fitting 2 which is formed in one piece with the wall 1 of the container so as to provide a reliable seal. The fabrication cost is reduced and fabrication is simplified since the tubular fitting 2 is formed directly from the material of the upper wall 1. The threaded bushing itself is a simple part which can be readily made on a conventional screw machine and is inexpensive. Mounting is effected by simple pressing and, in the case of use of a threaded connection, by rotation. When an industrial adhesive is applied between the threaded bushing and the tubular fitting, the connection is permanent. The invention simplifies the fabrication of containers, especially bung-drums and barrels while ensuring that the interior of the container will remain sealed.

I claim:

1. A sheet-metal container, comprising:

a container body composed of sheet metal and having top and bottom walls;

a tubular fitting projecting outwardly from said container body formed from the sheet metal of one of said walls and unitary therewith, said tubular fitting having a bend at its junction with said one of said walls;

a threaded bushing received in said tubular fitting and formfittingly engaged therein, said bushing being provided with an internal screwthread, an outwardly extending flange on one end formfittingly engageable with said bend, and another end opposite said one end;

means forming an annular enlargement on a free end of said tubular fitting, said enlargement being a bulge projecting inwardly to overhang said other end of said bushing; and a closure stopper threadedly received in said tubular fitting and having an external screw thread threaded into said internal screwthread, an annular shoulder juxtaposed with said annular enlargement, and an annular seal clamped between said shoulder and said enlargement, said stopper drawing said flange against said bend and said other end against said enlargement, said other end having an outwardly concave shape complementarily engaging an inwardly convex portion of said bulge.

2. The container defined in claim 1 wherein said threaded bushing is held in a press fit in said tubular fitting.

3. The container defined in claim 1 wherein said fitting and said bushing have seating surfaces engaging one another, at least one of said surfaces being textured to ensure reliable seating of said surfaces against one another.

4. The container defined in claim 1 wherein said fitting and said bushing have seating surfaces, said container further comprising an adhesive between said surfaces.

5. The container defined in claim 1 wherein said enlargement is a junction between a portion of said tubular fitting extending away from said one of said walls and an inner wall extending toward the interior of said container from said junction, said inner wall being formed with means for retaining said bushing in said tubular fitting.

6. The container defined in claim 1 wherein said bushing is formed with a noncylindrical contour over at least a portion of its height and said tubular formation is shaped to conform to said noncylindrical contour.

* * * * *